US007078604B2

(12) United States Patent
Rapaport

(10) Patent No.: US 7,078,604 B2
(45) Date of Patent: Jul. 18, 2006

(54) DETACHABLE STRINGED MUSICAL INSTRUMENT PICK

(76) Inventor: Neil Rapaport, 9772 Cactus Ave., Chatsworth, CA (US) 91311

( * ) Notice: Subject to any disclaimer, the term of this patent is extended or adjusted under 35 U.S.C. 154(b) by 0 days.

(21) Appl. No.: 10/964,953

(22) Filed: Oct. 13, 2004

(65) Prior Publication Data

US 2005/0211055 A1 Sep. 29, 2005

Related U.S. Application Data

(63) Continuation-in-part of application No. 10/811,091, filed on Mar. 26, 2004.

(51) Int. Cl.
*G10D 3/16* (2006.01)

(52) U.S. Cl. ..... 84/322

(58) Field of Classification Search ..... 84/320–322; D17/20; 273/153 R, 156; 29/896.22, 34 R
See application file for complete search history.

(56) References Cited

U.S. PATENT DOCUMENTS

| | | | | | |
|---|---|---|---|---|---|
| 5,587,542 | A * | 12/1996 | Everly | 84/322 |
| 5,905,217 | A * | 5/1999 | Byers | 84/322 |
| D412,010 | S * | 7/1999 | Lindley et al. | D17/20 |
| 6,054,643 | A * | 4/2000 | Chance et al. | 84/322 |
| 2004/0237753 | A1 * | 12/2004 | Savage | 84/322 |

* cited by examiner

*Primary Examiner*—Kimberly Lockett
(74) *Attorney, Agent, or Firm*—Christie, Parker & Hale, LLP

(57) ABSTRACT

The invention is a detachable musical instrument pick. A sheet of material is provided that has a plurality of musical instrument picks formed therein by a cut line around the perimeter of the picks. The picks are detachably retained on the sheet of material by at least one of an interference fit between the picks and the sheet of material and an uncut web joining the picks to the sheet of material. A pick can be detached from the card body by severing the web to remove a pick when desired and/or by interrupting the interference fit to reveal a pick-shaped aperture, and can be replaced back in the aperture for storage. The sheet of material can be sized to be carried in a purse or wallet or hung on a microphone stand and the like for easy access.

17 Claims, 5 Drawing Sheets

DETACHABLE STRINGED MUSICAL INSTRUMENT PICK

CROSS-REFERENCE TO RELATED APPLICATIONS

This application is a continuation-in-part of application Ser. No. 10/811,091, filed on Mar. 26, 2004.

SUMMARY OF THE INVENTION

The invention is in the field of plectrums, or "picks", for stringed musical instruments, and more particularly a pick for guitars and other stringed musical instruments that can be easily detached from a card, sheet, strip and the like.

Many stringed instruments such as guitars, mandolins, basses are played with picks, which consist of small generally flat pieces of material that are usually (but not always) flexible. Picks come in many sizes and are made of many kinds of materials including plastics (e.g. PVC, acetal polyoxymethylene (POM) resins (i.e. Delrin®), Nylon, etc), shell, metal, stone, paper, composite materials and other materials. Picks are manufactured to have a variety of thicknesses and stiffnesses, depending on a user's preferences. Picks are often shaped to have one or more rounded points, and can have a generally ogive shape at one or more ends. Picks come in numerous colors and can have graphics appearing thereon. Indeed, picks are collected by musicians and non-musicians alike.

Picks are often displayed at music stores in bulk in plastic bags, in open containers, displayed on paper displays, and the like.

Although picks can last a long time, they are frequently lost or misplaced, and users may wish to use different picks for different songs, instruments and conditions. Lacking a proper pick, a musician can improvise and use another object, such as a coin as a pick if required. It would be useful for musicians to have a convenient way to carry extra picks so that they are available anytime and any place.

It would also be useful to provide a readily accessible supply of picks to musicians during performances that can easily be taken when needed, yet will not be misplaced or lost.

BRIEF DESCRIPTION OF THE DRAWINGS

Further advantages of the invention will become apparent upon a reading of the following detailed description taken in conjunction with the accompanying drawings.

FIG. 7 is a top plan view of an exemplary embodiment of detachable picks on a strip of picks that can be supported on a microphone stand and the like.

DETAILED DESCRIPTION OF THE INVENTION

Figure 1:
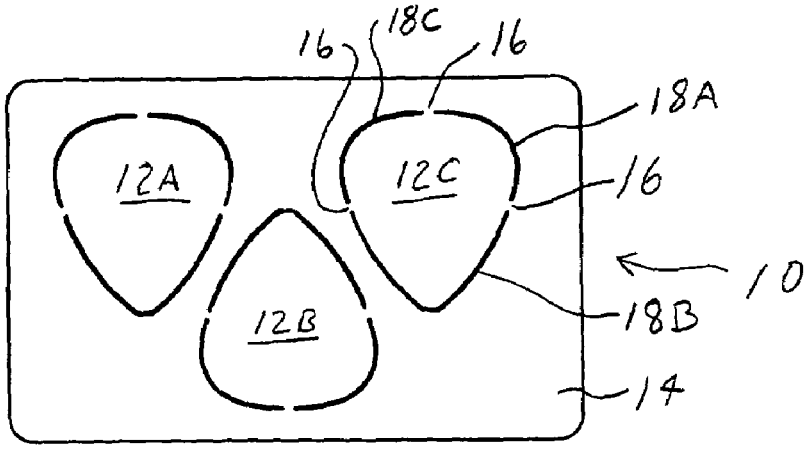
FIG. 1 is a top plan view of a first exemplary embodiment of a wallet-sized card of detachable picks.

Referring to FIG. 1, there is shown a top plan view of a first exemplary embodiment of a wallet-sized card 10 of detachable picks. In this card 10, three detachable picks 12A, 12B and 12C are attached to the card body 14 by webs 16 separating cut line sections 18A, 18B and 18C. The picks can be conveniently die-cut from the card leaving the webs intact so that the picks remain integral with the card until the webs are broken or cut (e.g. by pushing on the pick or slicing the webs with a blade.) The width and size of the webs can be varied depending on how much force is desired to remove a pick from the card. Although three webs 16 are shown bridging between each pick and the card body 10, a lesser or greater number of webs can be used depending on how secure the picks need to be carried on the card. Depending on the materials used, the card thickness (and thus pick thickness) can be varied to control the stiffness of the pick. Using PVC sheet material, good results have been achieved with 0.51 mm thickness material (0.02" or 20 mil), 0.76 mm thickness material (0.03" or 30 mil), 1.02 mm thickness material (0.04" or 40 mil), and 1.27 mm thickness material (0.05" or 50 mil). Other thicknesses can be used, and these thicknesses apply to all of the embodiments disclosed herein.

Figure 2:
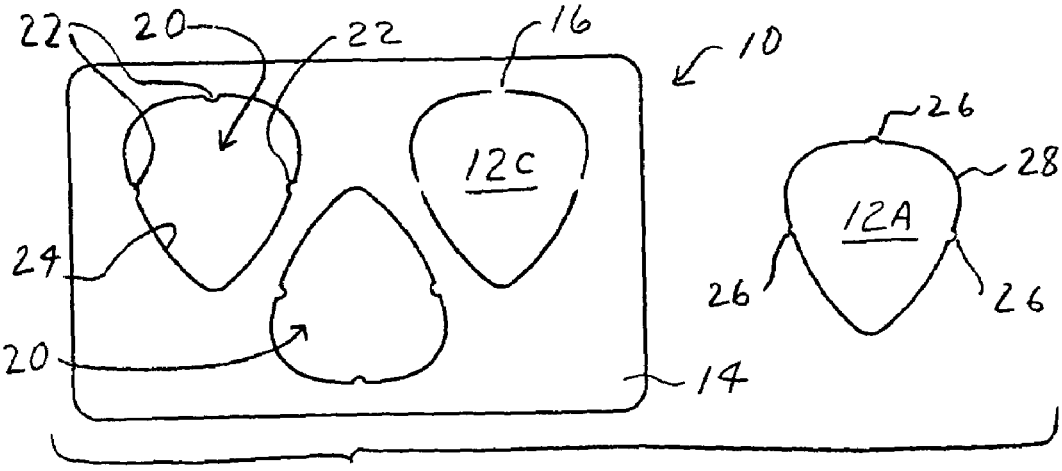
FIG. 2 is a top plan view of the wallet-sized card of FIG. 1 after one pick is removed and the removed pick.

FIG. 2 is a top plan view showing the wallet-sized card 10 of FIG. 1 with two picks removed and one of the removed picks 12A. As can be seen, after picks are removed from the card, holes 20 are left with remnants of webs 22 shown on the perimeter 24 of the cut line. Snapped off pick 12A is shown, with remnants of webs 26 shown around its perimeter 28

Figure 3:
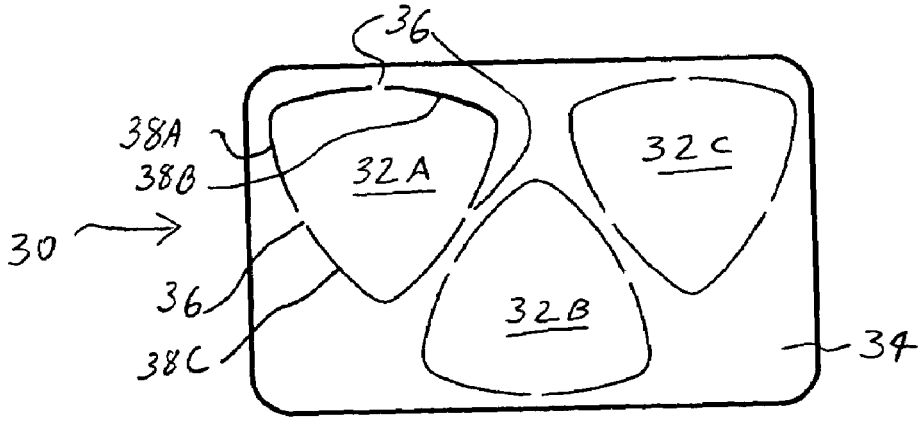
FIG. 3 is a top plan view of a second exemplary embodiment of a wallet-sized card of detachable picks.

FIG. 3 is a top plan view of a second exemplary embodiment of a wallet-sized card 30 of detachable picks. The picks 32A, 32B and 32C are integral with card body 34 and are connected therewith with webs 36, and are die cut from card with cut lines 38A, 38B and 38C between the webs. The picks 32A, 32B and 32C have a different shape than the picks 12A, 12B and 12C of FIGS. 1 and 2, but in other respects, this embodiment is similar.

Figure 4:
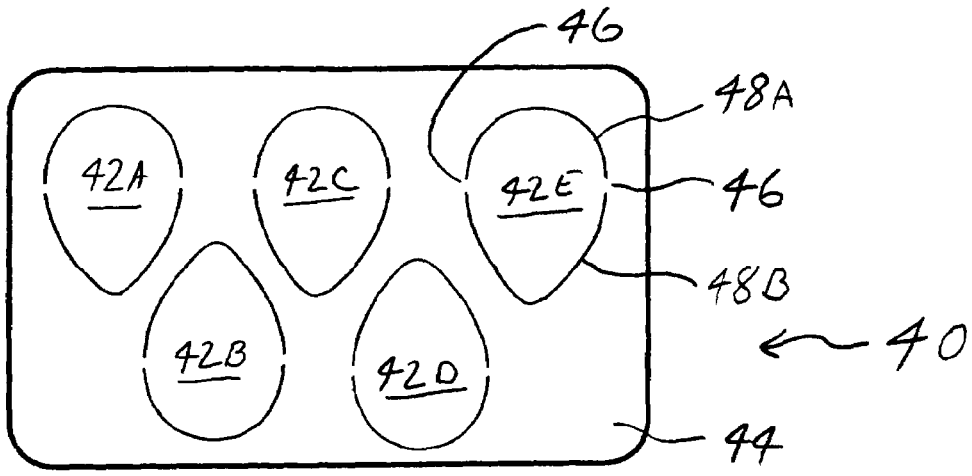
FIG. 4 is a top plan view of a third exemplary embodiment of a wallet-sized card of detachable picks.

FIG. 4 is a top plan view of a third exemplary embodiment of a wallet-sized card 40 of detachable picks, where the picks 42A, 42B, 42C, 42D and 42E are integral with card body 44 but each pick is connected to the card by two webs 46 and has cut lines 48A and 48B between the webs 46. While a total of five picks 42A, 42B, 42C, 42D and 42E are shown, a greater or lesser number of picks can be arranged on the card.

Figure 5:
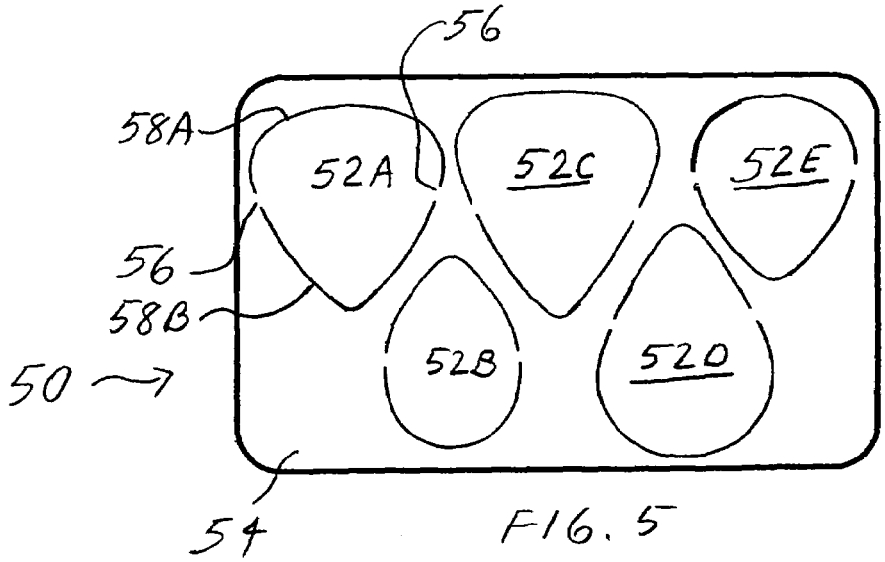
FIG. 5 is a top plan view of a fourth exemplary embodiment of a wallet-sized card of detachable picks.

FIG. 5 is a top plan view of a fourth exemplary embodiment of a wallet-sized card 50 of detachable picks, where the picks 52A, 52B, 52C, 52D and 52E are integral with card body 54 but each pick is connected to the card by two webs 56 and has cut lines 58A and 58B between the webs 56. While a total of five picks 52A, 52B, 52C, 52D and 52E are shown, a greater or lesser number of picks can be arranged on the card. In this embodiment, the picks 52A, 52B, 52C, 52D and 52E all have a different size and shape.

With respect to the card bodies of FIGS. 1–5, they can be conveniently sized to be the same or similar to charge cards, credit cards or business cards (e.g. from about 50.8 mm to 54 mm (2" to 2.125") by about 85.7 mm to 88.9 mm (3.375" to 3.5")) so that it can be conveniently carried in a user's wallet or handbag along with other similar sized cards. Naturally, other sizes can be used.

Figure 6:
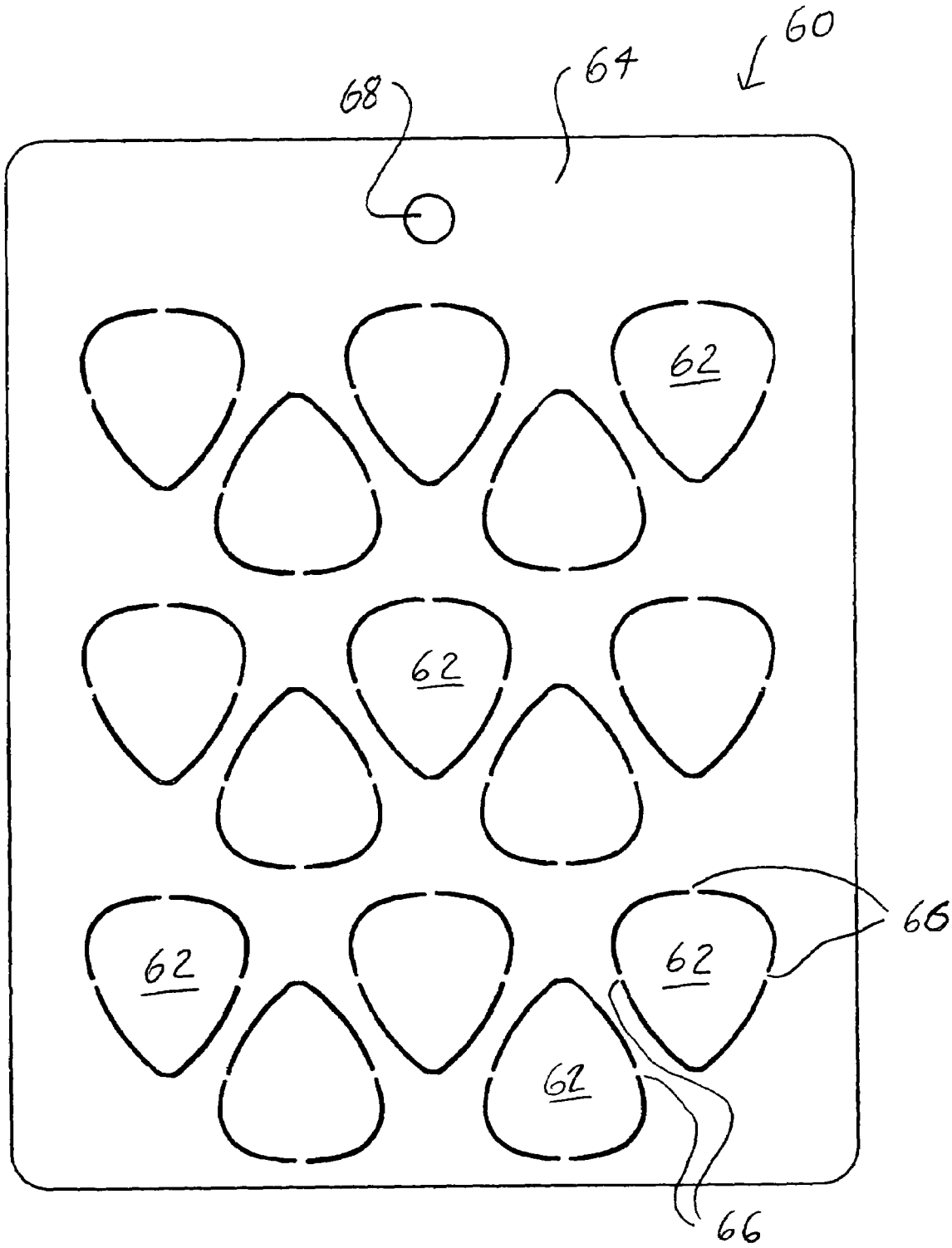
FIG. 6 is a top plan view of an exemplary embodiment of detachable picks on a larger sheet.

FIG. 6 is a top plan view of an exemplary embodiment of a large sheet 60 with detachable picks 62 die cut from a sheet of material 64. Each pick is detachably attached to the card body 64 by breakable and cutable webs 66. These large sheets can hang from a display stand by an optional hole 68 formed in the card body 64.

Figure 7:
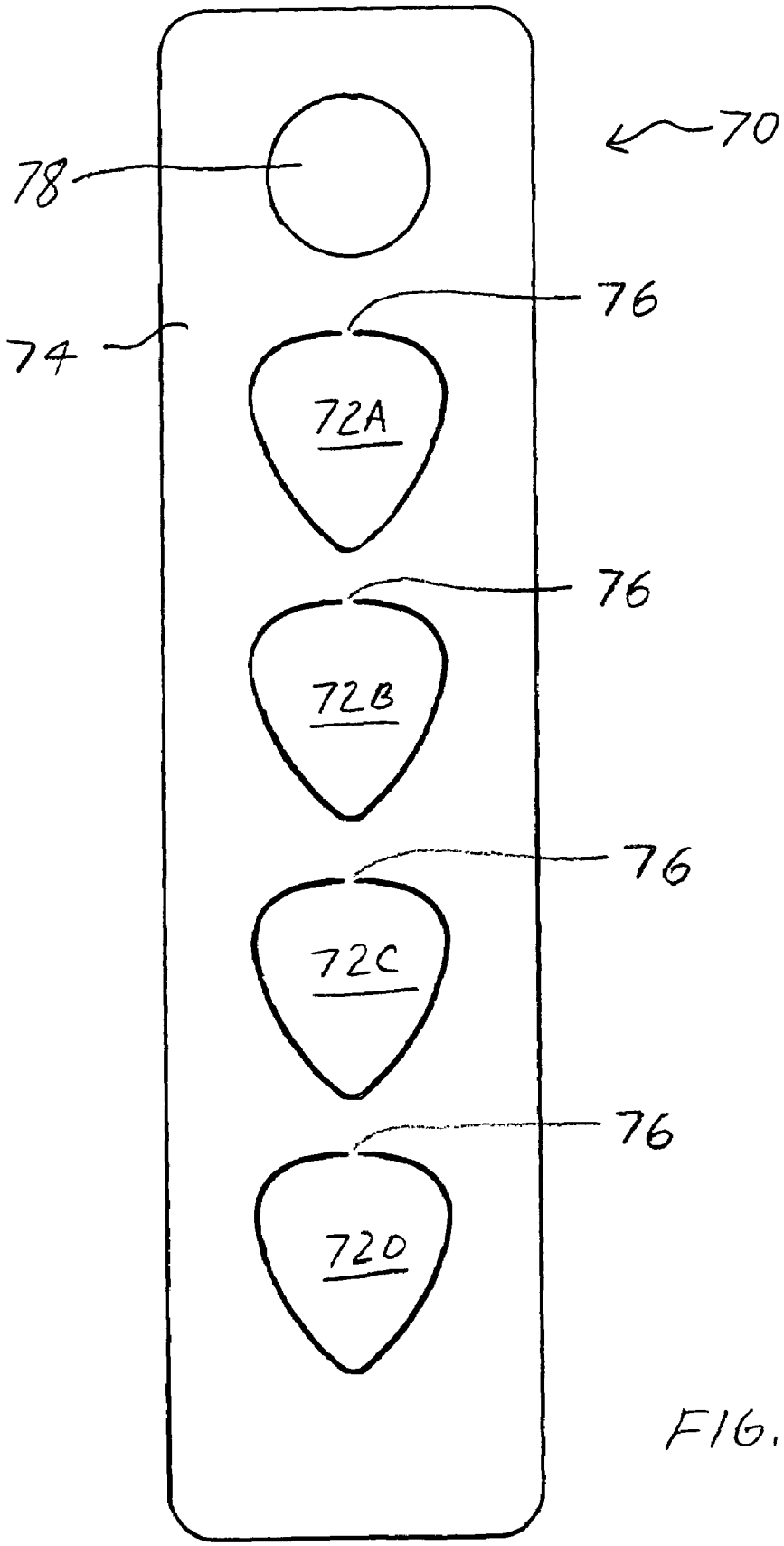

FIG. 7 is a top plan view of an exemplary embodiment of a strip 70 of detachable picks that can be hung from a microphone stand and the like. The strip 70 has a plurality of picks 72A, 72B, 72C and 72D integral with the strip body 74. The picks are attached to the strip body 74 by at least one web 76. The strip 70 will preferably have a hole 78 formed therein for hanging on a microphone stand or other support so that the picks are readily available during musical performances. If desired, instead of a hole, a die cut break away portion that will readily permit a hole to be formed in the strip can be provided in the strip (not shown.) With the single web design, one or more picks 72A, 72B, 72C and 72D can be swung out from the plain of the strip body 74 so that a user can easily grab a pick and twist it to free a pick very easily and quickly.

Figure 8:
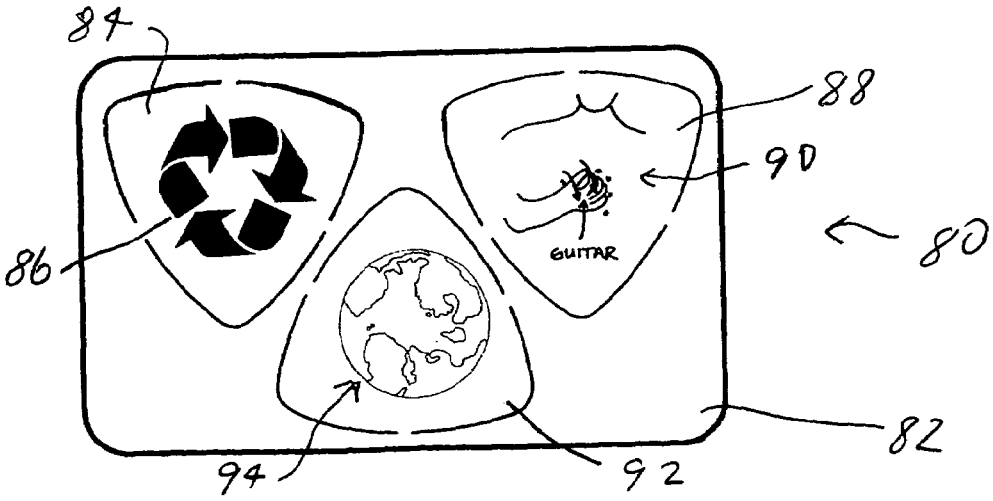
FIG. 8 is a top plan view of another exemplary embodiment of a wallet-sized card of detachable picks bearing graphical images.

Referring to FIG. 8, there is shown a top plan view of another exemplary embodiment of a wallet-sized card 80 of detachable picks 84, 88 and 92, wherein each pick bears graphical images 90, 86 and 94, respectively. A single card can also be printed with a single image, and each pick can bear a part of that entire image. The physical construction of this exemplary embodiment can be similar to that shown in FIG. 3.

Figure 9:
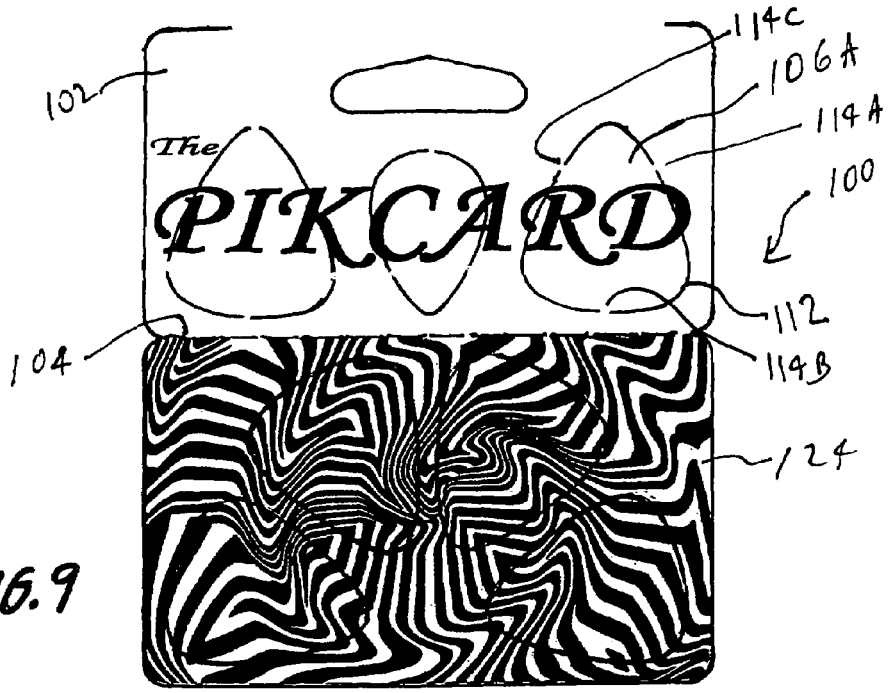
FIG. 9 is a top plan view of another exemplary embodiment of a two-part card containing detachable picks.
Figure 10:
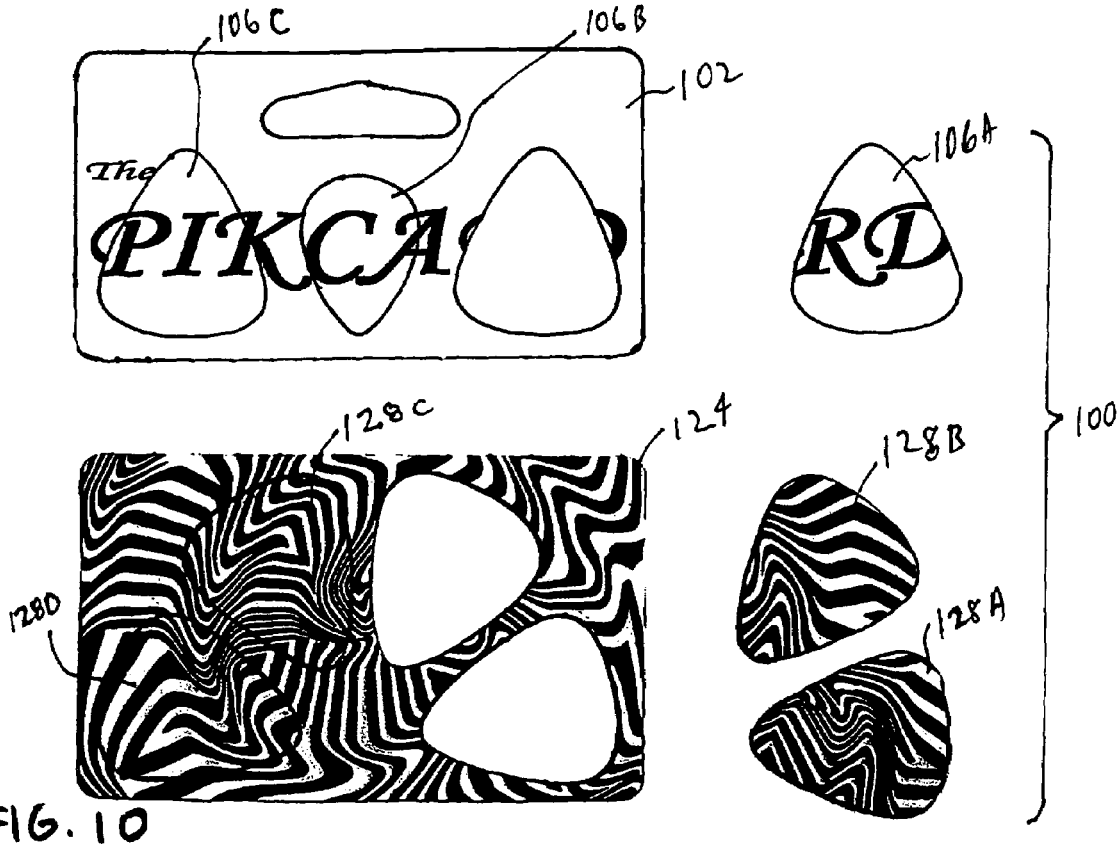
FIG. 10 is a top plan view of the embodiment of a two-part card containing detachable picks of FIG. 9, with the two part card detached into two sections and with one pick detached from one of the two cards.

FIG. 9 is a top plan view of another exemplary embodiment of a two-part card 100 that has a first part 102 and a second part 104, with detachable picks 106A, 106B and 106C carried on first part 102 and has detachable picks 108A, 108B, 108C and 108D carried on second part 104. For purposes of illustration of this exemplary embodiment, detachable pick 106B is shown as having a different shape and size compared to detachable picks 106A, 106C, 108A, 108B, 108C and 108D, but the size and number of detachable picks can be varied as desired. The first part 102 and a second part 104 are shown as being detachably connected together with a serration line 110 that permits the first part 102 and second part 104 to be snapped apart, as best shown in FIG. 10. Also, while two separable parts 102 and 104 are shown, a single card can also be provided, or more than two portions can be provided. The two parts 102 and 104 can preferably be sized to have roughly the same dimensions as standard credit cards, viz., about 8.57 cm×5.40 cm (3 ⅜"×2 ⅛") or smaller so as to be capable of being stored by users in wallets, billfolds and the like. However, other card sizes can also be used if desired. For purposes of allowing ready display of the two-part card 100 on a retail display, a suspension aperture 110 may optionally be provided in the first part 102 of the two part card 100. Graphics 116 and 118 can appear on the card parts 102 and 104.

With modern die cutting equipment, very thin die cut lines can be formed such that the cut line does not remove much, if any, material along the cut line. Accordingly, with use of the proper die cutting equipment, the object being die cut ("die cut object") from a section of material ("base material") may be snapped back into place and frictionally retained with an interference fit in the opening in the base material from which the die cut object was cut. In such cases, interruption(s) in the die cut line to form webs between the die cut object and the base material can be made to be very thin so that the dimensions and number of webs can be adjusted as desired to adjust the amount of force necessary to be applied to detach a die cut object from the base material. In cases where the die cut line is very thin and there is a sufficient interference fit between the die cut object and the base material, it is possible to eliminate webs entirely or make them exceptionally narrow so that the die cut object when removed from the base material detaches cleanly from the base material and leaves little if no remnant of the web on the perimeter of the die cut object, thereby providing a smooth edge of the object. Also, depending on the thickness of the blade used and angle of the cutting edge of the blade, when die cutting the object from the base material, the perimeter edge of the pick may become somewhat rounded off and become very smooth.

Referring again to FIG. 9, there is shown a top plan view of an exemplary embodiment of two-part card 100 of detachable picks with cards 102 and 124 that are connected together by a frangible line 104. Referring to pick 106A, it is formed by a cut line 112 that goes around substantially all of the pick's perimeter, except for interruptions 114A, 114B and 114C that form webs between the pick 106A and the first part 102. The picks can be conveniently die-cut from the card leaving the webs 114A, 114B and 114C intact so that the pick 106A remains integral with the first part 102 of the card 100 until the webs are broken or cut (e.g. by pushing on the pick). The width and size of the webs can be varied depending on how much force is desired to remove a pick from the card, although as noted above, it is possible to eliminate webs entirely if the interference fit between the picks and the cards is sufficiently great to prevent the picks from falling out of the card. Although three webs 114A, 114B and 114C are shown bridging between each pick and the first card part 102, a greater or lesser number of webs can be used depending on how secure the picks need to be carried on the card. The card thickness (and thus pick thickness) and type of sheet material chosen can be selected to determine the stiffness of the detachable pick.

FIG. 10 is a top plan view of the two-part card 100 of FIG. 9, with the two part card detached into two parts 102 and 124 and with one pick 106A detached from part 102 and with picks 128A and 128B detached from part 124. Picks 106B and 106C remain attached to part 102 and picks 128C and 128D remain attached to part 124. Graphics (e.g., a zebra pattern) 130 are located on part 124 which are different than the indicia (e.g., the word "The PIKCARD") 118 that appears on card 102. The graphics and indicia can extend across more than one pick, as shown, if desired.

The cards 10, 30, 40, 50, 60, 70, 80 and 100 can be made of material such as plastic (e.g., polyvinyl chloride (PVC), acetal polyoxymethylene (POM) resins (i.e. Delrin®), polycarbonate, Nylon, etc., Teslin® (a synthetic dimensionally stable, highly filled, single layer, microporous film that is polyolefin-based with 60% of its weight comprised of non-abrasive filler and 65% of its volume comprised of air), laminated paper, composite materials, etc., and the like.

Although a preferred embodiment of the present invention has been described, it should not be construed to limit the scope of the appended claims. For example, the present invention may be implemented to include a variety of different pick sizes, shapes, thicknesses and layouts.

In addition, those skilled in the art will understand that various modifications may be made to the described embodiment. Moreover, to those skilled in the various arts, the invention itself herein will suggest solutions to other tasks and adaptations for other applications. It is therefore desired that the present embodiments be considered in all respects as illustrative and not restrictive, reference being made to the appended claims rather than the foregoing description to indicate the scope of the invention.

What is claimed is:

1. Detachable musical instrument picks, comprising:

a sheet of material with at least one musical instrument pick formed therein by at least one cut line formed around at least a portion of the pick, wherein the at least one musical instrument pick is detachably attached to the rest of the sheet of material by an interference fit between the pick and the sheet of material along the at least one cut line, and by at least one uncut area around the at least one pick that defines a web joining the at least one pick to a card body outside of the at least one cut line, wherein the pick is detached from the card body by displacing the at least one pick from the card body to interrupt the interference fit and also by severing the at least one web, and wherein a perimeter edge is formed to allow said at least one pick to be reattached to said card body, and wherein said pick is formed such that said pick is brought back into contact in an interference fit with said perimeter edge of an aperture, said aperture is being formed when said pick is removed from said card body.

2. The detachable musical instrument pick of claim 1, wherein the sheet of flat material comprises generally rigid plastic sheet material.

3. The detachable musical instrument pick of claim 1, wherein the cut lines are formed by die cutting.

4. The detachable musical instrument pick of claim 1, wherein the sheet of flat material comprises a first and second portion which are separatable, with each of the first and second portion carrying detachable picks.

5. The detachable musical instrument pick of claim 1, wherein the plurality of picks on a sheet have the same size and shape.

6. The detachable musical instrument pick of claim 1, wherein the plurality of picks on a sheet are different in at least one of size and shape.

7. The detachable musical instrument pick of claim 1, further comprising an aperture for carrying the card body on another structure.

8. The detachable musical instrument pick of claim 7, wherein the aperture is one of preformed on the card body and comprising a break-away section that can be readily removed to expose the aperture when desired by the user.

9. The detachable musical instrument pick of claim 1, wherein each pick is attached to the card body by a single web.

10. The detachable musical instrument pick of claim 1, wherein the sheet of flat material is selected from the group consisting of plastic sheet material, shell, bone, metal and paper.

11. The detachable musical instrument pick of claim 1, wherein the sheet of material is flat.

12. The detachable musical instrument pick of claim 1, wherein the picks bear graphical indicia.

13. Detachable musical instrument picks, comprising:

a sheet of material with a plurality of musical instrument pick formed therein by at least one cut line formed around a perimeter of the picks, wherein the picks are detachably attached to the rest of the sheet of material by an interference fit between the pick and the sheet of material along the at least one cut line, and by at least one uncut area around the picks that define a web joining the picks to a card body outside of the at least one cut line, wherein the picks are detachable from the card body by displacing the picks from the card body to interrupt the interference fit and also by severing the at least one web, and wherein a perimeter edge is formed to allow said at least one pick to be reattached to said card body, and wherein said pick is formed such that said pick is brought back into contact in an interference fit with said perimeter edge of an aperture, said aperture is being formed when said pick is removed from said card body.

14. The detachable musical instrument pick of claim 13, wherein the sheet of flat material comprises generally rigid plastic sheet material.

15. The detachable musical instrument pick of claim 13, wherein the sheet of flat material comprises a first and second portion which are separable, with each of the first and second portions carrying detachable picks.

16. The detachable musical instrument pick of claim 13, further comprising an aperture for carrying the card body on another structure.

17. The detachable musical instrument pick of claim 13, wherein the picks bear graphical indicia.

* * * * *